US007561843B2

(12) United States Patent
deJong et al.

(10) Patent No.: US 7,561,843 B2
(45) Date of Patent: Jul. 14, 2009

(54) METHOD AND SYSTEM OF PAPER REGISTRATION FOR TWO-SIDED IMAGING

(75) Inventors: Joannes N. M. deJong, Hopewell Jct., NY (US); Lloyd A. Williams, Mahopoc, NY (US)

(73) Assignee: Xerox Corporation, Norwalk, CT (US)

( * ) Notice: Subject to any disclaimer, the term of this patent is extended or adjusted under 35 U.S.C. 154(b) by 579 days.

(21) Appl. No.: 11/193,591

(22) Filed: Jul. 29, 2005

(65) Prior Publication Data

US 2007/0025788 A1 Feb. 1, 2007

(51) Int. Cl.
*G03G 15/00* (2006.01)
*B65H 7/00* (2006.01)

(52) U.S. Cl. ..... 399/364; 399/361; 399/388; 399/394; 399/395; 271/226; 271/227

(58) Field of Classification Search ..... 399/361, 399/363, 364, 381, 388, 389, 394, 395, 396, 399/397, 401; 347/104; 271/226–255, 265.01, 271/265.02, 265.03; *G03G 15/00; B65H 7/00*
See application file for complete search history.

(56) References Cited

U.S. PATENT DOCUMENTS 4,511,242 A * 4/1985 Ashbee et al. ..... 399/395
4,944,505 A * 7/1990 Sherman, III ..... 271/265.03
5,172,907 A * 12/1992 Kalisiak ..... 271/227
5,930,577 A * 7/1999 Forsthoefel et al. ..... 399/401
6,340,984 B1 * 1/2002 Ui et al. ..... 347/139
6,511,239 B1 1/2003 Kretschmann et al.
6,533,268 B2 3/2003 Williams et al.
6,575,458 B2 6/2003 Williams et al.
6,578,844 B2 * 6/2003 Acquaviva et al. ..... 271/228
6,647,884 B1 * 11/2003 La Vos et al. ..... 101/485
6,731,887 B1 * 5/2004 Wibbels et al. ..... 399/45
6,866,260 B2 * 3/2005 Williams et al. ..... 271/227
6,895,210 B1 * 5/2005 Quesnel ..... 399/395
6,988,725 B2 * 1/2006 Rapkin ..... 271/227
7,243,917 B2 * 7/2007 Knierim et al. ..... 271/228
7,258,340 B2 * 8/2007 Clark et al. ..... 271/228
2002/0006287 A1 * 1/2002 Dobberstein et al. ..... 399/45
2004/0065994 A1 4/2004 Halvonik et al.

FOREIGN PATENT DOCUMENTS

JP 63001668 A * 1/1998
JP 2002031923 A * 1/2002

* cited by examiner

*Primary Examiner*—Judy Nguyen
*Assistant Examiner*—'Wyn' Q Ha
(74) *Attorney, Agent, or Firm*—Maginot, Moore & Beck LLP

(57) ABSTRACT

A registration and measurement system for a printing machine includes two drive rollers and two opposing idler rollers. Each drive roller and idle roller combination respectively form a drive nip. A single servo or stepper motor is operably connected to the drive rollers through a gear train, allowing the motor to drive the sheet feeding nips. A rotary encoder is attached to each idler roller. Optical sensors are provided above a desired sheet path. The optical sensors and the rotary encoders are connected to a controller and are operable to deliver output signals to the controller. The controller is operable to determine the length of a sheet passing through the nips based upon the signals received from the optical sensors and the rotary encoders.

22 Claims, 6 Drawing Sheets

METHOD AND SYSTEM OF PAPER REGISTRATION FOR TWO-SIDED IMAGING

TECHNICAL FIELD

The present disclosure relates generally to printing machines such as electrostatographic or xerographic printing machines, and more particularly concerns a sheet registration apparatus using such printing machines.

BACKGROUND

Sheet registration systems deliver sheets of all kinds to specified positions and angles for subsequent functions within printers, copiers and other printing machines. The subsequent functions may include transferring an image to the sheet, stacking the sheet, slitting the sheet, etc. Conventional registration systems correct for skew, lateral offset, and process errors. "Skew" is the angle the leading edge of a sheet being transferred differs from perpendicular to the desired direction of transfer. "Lateral offset" or "cross process offset: is the lateral misalignment of the sheet being transferred with respect to the desired transfer path. "Process" relates to the timing of the sheet within the printing machine such that the sheet arrives at various destinations at the proper times.

Examples of skew contributors include (i) the angle at which a sheet is supplied into the sheet drive apparatus, (ii) skew induced when the sheet is acquired by the feeder, and (iii) drive roller velocity differences between drive rollers on opposite ends of a common drive shaft. Typical reasons for lateral offset include improper sheet supply location and sheet drive direction error. Sheet drive direction error is caused by the sheet drive shafts not being perpendicular to the intended sheet drive direction. This is a result of tolerances and excess clearance between drive shafts and frames, sheet transport mounting features and machine frames and machine module to module mounting. A typical reason for a process error may be an incorrect nip drive speed.

In present day high speed copiers and printers, active registration systems are used to register the sheets accurately. In an active registration system, a sheet is passed over sensor arrays from which the sheet skew, lateral offset, and process errors are calculated. Skew is corrected in some registration systems by rotating drive rollers on opposite ends of a common drive axis at different velocities. Lateral offset may be corrected, for example, by moving the rollers in unison to one side or another. Process errors may be corrected, for example, by driving the rollers faster or slower.

Upon completion of the registration process corrects for skew, lateral offset, and process errors the sheet is correctly aligned along a desired transfer path and ready to receive an image within a pre-defined image area. In a typical application, the predefined image area is the area defined within 1 inch margins or borders of the sheet. Following the registration process each sheet is delivered to an imaging station where an image is created on the surface of the sheet. In certain printing machines, the sheet is then passed through a fuser that fuses the image to the sheet. It is typically desirable for the image to be centered within the predefined image area.

Duplex printing generally refers to the process of printing an image on a first side and a reverse side of a single sheet. The duplex printing process typically begins with a sheet being fed through a sheet feeder and into a transfer path. The sheet then encounters a sheet registration system that collects information concerning the orientation of the sheet, such as skew and lateral offset, and may re-orient the sheet to place it in better position for imaging. Thereafter, the sheet is moved to an imager located downstream from the registration system. The imager transfers developed images from a photoreceptor to the sheet, thus creating an image on the sheet. After this, the sheet is passed on to a fusing station where the image is fused to the first side of the sheet. During this first imaging process, the first side of the sheet is the upper side and the reverse side of the sheet is the lower side.

After an image is created on the first side of the sheet, the duplex printing process continues as the sheet is inverted in a sheet inverter such that the first side becomes the lower side and the reverse side becomes the upper side. The sheet is then moved along a duplex path to an inverter. The inverter flips the sheet such that what was the leading edge of the sheet during the first imaging process becomes the trailing edge of the sheet during the second imaging process. After inversion, the sheet is returned to the transfer path for re-registered of the sheet for the second imaging process. After the sheet is re-registered, the sheet is passed through the imaging and fusing process, thereby placing an image within a second predefined area on the reverse side of the sheet. In the end, it is desirable for the first pre-defined image area to match the second pre-defined image area such that the image on the first side appears within the same sheet boundaries as the image on the reverse side when the sheet is inspected by holding the sheet up to a light. The intended alignment of the image on the first side with the image on the second side is often referred to as see-through registration.

Improper sheet size is a major factor contributing to misalignment of images on opposite sides of a sheet of paper during the duplex printing process. An improper sheet size is often the result of a sheet of paper that is (i) non-rectangular or (ii) wider or narrower than intended (e.g., slightly greater than or slightly less than 8½" wide). Improper sheet size is generally attributable to paper manufacturing defects, large manufacturing tolerances in paper size, or changes in size of the paper during fusing before the second imaging process.

An example of the problem created by an improper sheet size is shown with reference to FIG. 5. In FIG. 5, the bold outer perimeter 52 represents a non-rectangular sheet of paper 52. The non-rectangular character of the sheets is exaggerated in FIG. 5 over that of a typical non-rectangular sheet for emphasis. As shown in FIG. 5, the leading edge 54 of the sheet is not parallel with the trailing edge 56 of the sheet. A first image is printed on the first side of the sheet within a first predefined image area 60 which is defined in FIG. 5 by the solid line on the sheet. The first image area 60 includes a border 61 that is aligned with the leading edge of the sheet. After the first image is created during the duplex printing process, the sheet is flipped such that the former leading edge 54 becomes the trailing edge and vice-versa. Then, a second image is printed on the reverse side of the sheet within a second predefined image area 62 which is defined in FIG. 5 by the dotted line on the sheet. The second image area 62 includes a border 63 that is aligned with the new leading edge of the sheet 56 (which was formerly the trailing edge). As shown in FIG. 5, the first image area 60 on the first side of the sheet is not aligned with the second image area 62 on the reverse side of the sheet, creating duplex image misalignment when a see-through inspection of the image is made.

Although FIG. 5 represents a situation where the sheet is non-rectangular, similar see-through registration problems occur during the duplex printing process when the distance from the leading edge to the trailing edge of the sheet is longer or shorter than expected. Accordingly, it would be desirable to provide a printing system capable of accurately producing duplex images where a first side image is aligned with a reverse side image when a see-through inspection of the sheet is made.

SUMMARY

According to the aspects illustrated herein, there is provided a sheet measurement system comprising at least one nip assembly operable to receive a sheet. The nip assembly includes at least one nip parameter sensor operable to provide a nip parameter signal. The sheet measurement system also comprises at least one sheet sensor operable to detect the presence of the sheet and provide a sheet detection signal. The sheet measurement system further comprises a processor, such as a microprocessor, operably connected to the at least one nip assembly and the at least one sensor. The microprocessor is operable to determine a distance of the sheet based upon the nip parameter signal and the sheet detection signal.

According to the aspects illustrated herein, there is provided a printing machine operable to print an image on a first side and a reverse side of a sheet having a first edge and a second edge. The printing machine comprises at least one nip assembly including a drive roller and an idler roller. The nip assembly is operable to receive the sheet between the drive roller and the idler roller. The nip assembly is further operable to provide a nip parameter signal. The printing machine also comprises at least one sensor operable to detect the presence of the sheet received between the drive roller and the idler roller. The at least one sensor is operable to provide a sheet detection signal. Furthermore, the printing machine comprises a microprocessor operable to determine a distance between the first edge of the sheet and the second edge of the sheet based upon the nip parameter signal and the sheet detection signal. The microprocessor is also operable to determine a first image area for the first side of the sheet and a second image area for the reverse side of the sheet, wherein the first image area is substantially symmetric to the second image area with respect to the sheet. The printing machine further comprises an imager operable to create an image on the sheet.

According to the aspects illustrated herein, there is disclosed a method of registering a sheet in a printing machine, wherein the sheet includes a first side and a reverse side, and the printing machine comprises at least one nip assembly having at least one roller. The method comprises determining the presence of the sheet in the nip assembly, monitoring rotation of the at least one roller, and determining the length of the sheet based on the presence of the sheet in the nip assembly and the monitored rotation of the at least one roller.

The term "printer" or "printing machine" as used herein broadly encompasses various printers, copiers, or multifunction machines or systems, xerographic or otherwise, unless otherwise defined in a claim. The term "sheet" as used herein refers to a usually flimsy physical sheet of paper, plastic, or other suitable physical substrate for receiving images. The term "duplex" as used herein refers to a sheet having an image on both sides.

DESCRIPTION

Figure 1:
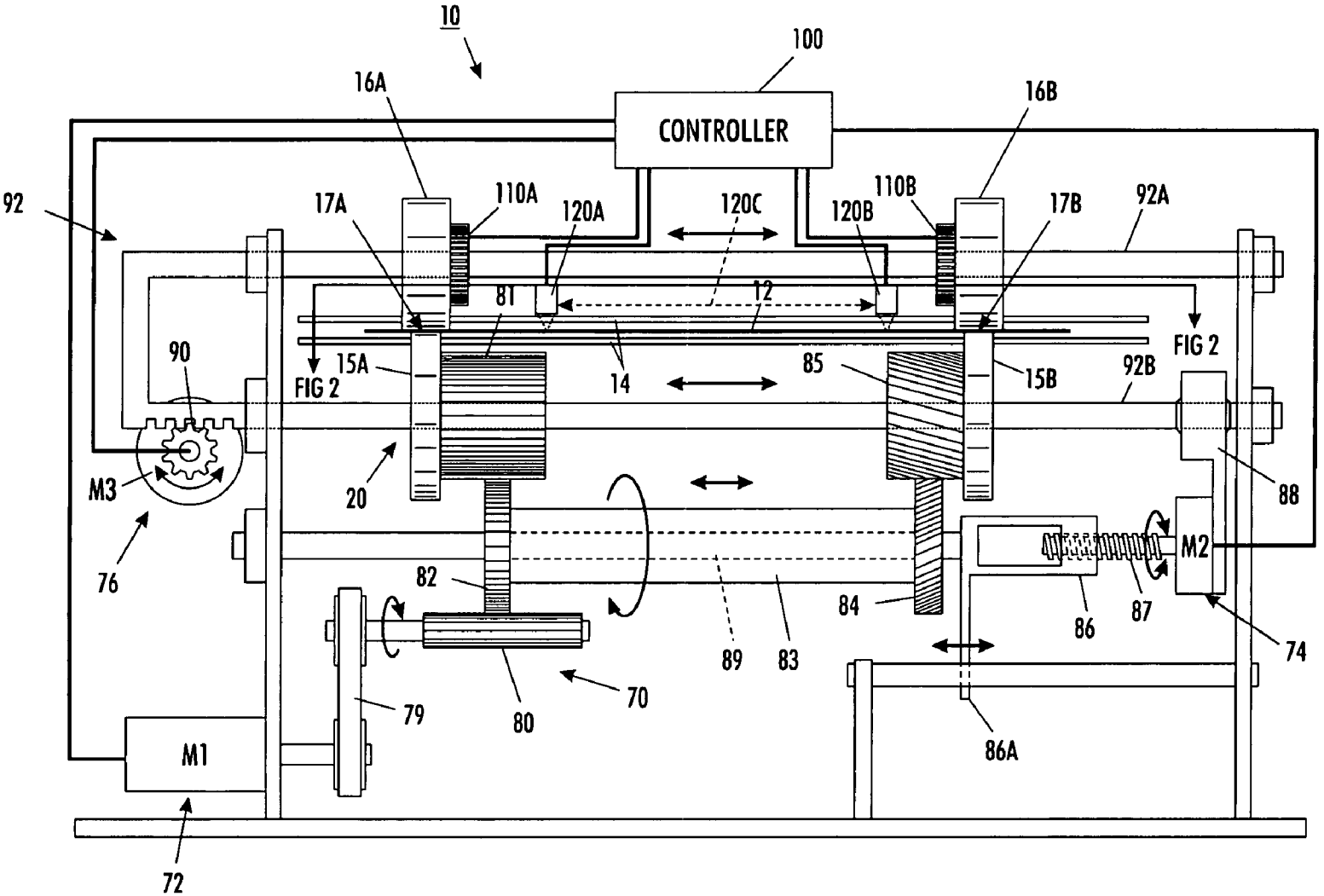
FIG. 1 shows an elevational front view of a registration and measurement system for a printing machine operable to print duplex images.

With reference to FIG. 1, a registration and measurement system 10 for a printing machine is shown. The registration and measurement system includes a nip assembly 20, a plurality of sheet sensors 120A and 120B, a controller 100, and a plurality of drive assemblies. The plurality of drive assemblies include a primary drive assembly 72, a skew drive assembly 74, and a lateral offset drive assembly 76. The controller 100 is operable to receive inputs from the nip assembly and the sensors 120A and 120B, and control the drive assemblies. The controller 100 may comprise an electronic processor, such as a microprocessor, and is operable to receive input signals and deliver output signals, such as control signals that control the operation of various electric motors.

The nip assembly 20 of the registration and measurement system includes two drive rollers 15A and 15B and two opposing idler rollers 16A and 16B. Each drive roller and idle roller combination 15A, 16A or 15B, 16B respectively form a drive nip 17A or 17B. The surface of the drive rollers 15A and 15B comprise an elastomer material, such as a urethane coating. In contrast to the surface of the drive rollers 15A and 15B, the idler rollers 16A and 16B are comprised of a hard substantially inelastic material, such as metal or hard plastic.

As discussed in U.S. patent application Ser. No. 10/855,451, filed May 27, 2004, the disclosure of which is incorporated herein by reference in its entirety, the ratio of sheet speed through the drive nips 17A and 17B to angular velocity of the drive rollers 15A and 15B is ideally unity. However, the elastomer on the drive rollers 15A and 15B, as well as other factors, can cause the drive ratio to be less than unity. A better indicator of sheet speed through the drive nips 17A and 17B is often the angular velocity of the idler rollers 16A and 16B, each of which are void of an elastomer surface.

The nip assembly 20 of the registration and measurement system 10 of FIG. 1 further includes two nip parameter sensors operable to provide a nip output signal. In the embodiment of FIG. 1, the nip parameter sensors are rotary encoders 110A and 110B connected to the idler rollers 16A and 16B. The rotary encoders 110A and 110B are operable to monitor the velocity of each idler roller 16A and 16B and produce a nip output signal in the form of a signals indicative of the angular velocity of the idler rollers. The rotary encoders may be, for example, incremental rotary encoders having an etched glass incremental encoder wheel with a resolution of less than 0.1°. The rotary encoders 110A and 110B each include an output that is connected to the controller 100. The rotary encoders deliver signals, such as a square waves, to the controller 100 though their outputs indicating the angular velocity and/or distance of travel of the drive rollers.

Figure 2:
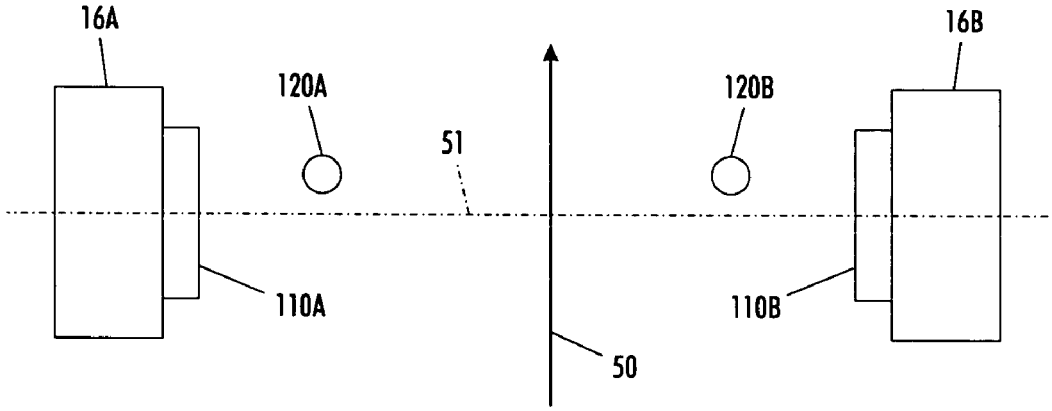
FIG. 2 is a cross-sectional view of the registration and measurement system along line FIG. 2-FIG. 2 of FIG. 1.

Sheet sensors 120A and 120B are positioned near the drive nips 17A and 17B above a desired sheet path, defined in part by baffles 14. As shown in FIG. 2, the sheet sensors 120A and 120B are positioned slightly away from a center line 51 that joins the idler rollers 16A and 16B, as the sheet sensors must be clear of the axis 92A joining the idler rollers. The sheet sensors 120A and 120B may be any of various different types of sensors capable of detecting the presence of a sheet. In the embodiment shown in FIGS. 1 and 2, the sheet sensors are optical sheet sensors 120A and 120B, such as infrared sensors. Like the rotary encoders 110A and 110B, the optical sensors 120A and 120B are connected to a controller 100. The optical sensors 120A and 120B are operable to deliver output signals to the controller in the form of sheet detection sensors. Based on the output signals from the optical sensors 120A and 120B, as well as the output signals from the rotary encoder 110A and 110B, the controller 100 is operable to determine the length of a sheet 12 passing through the nips 17A and 17B.

The primary drive assembly 72 powers the sheet feeding nips 17A and 17B. As shown in FIG. 1, the primary drive assembly includes a single servo or stepper motor M1 operably connected to the drive rollers 15A and 15B through a gear train 70. In particular, the motor M1 drives the gear train 70, which is connected to the nips 17A and 17B. The gear train comprises an elongated straight gear 80 connected to the motor M1 via a timing belt 79. The elongated straight gear 80 engages an intermediate gear 82, which in turn engages a straight gear 81. The gear 81 is directly connected to the drive roller 15A, which defines the first drive nip 17A. Both gear 81 and its connected drive roller 15A are freely rotatably mounted on a mounting shaft 92B. The intermediate gear 82 is connected to and rotates an interconnecting hollow drive shaft 82, which rotates around a shaft 89 which can translate, but does not need to rotate. The gears 80 and 81 have sufficient lateral (axial) teeth extension to allow the intermediate gear 82 and its shafts 83 and 89 to move laterally relative to the gears 81 and 80 and remain engaged.

Opposite the intermediate gear 82 along the hollow drive shaft 83 is mounted a helical gear 84, which rotates with the intermediate gear 82. This helical gear 84 engages another helical gear 85, which is fastened to the drive roller 15B of the second nip 17B to rotatably drive the drive roller 15B. Thus, absent any axial movement of the shafts 83 and 89, the motor M1 positively drives both of the sheet nips 17A and 17B with essentially the same rotational speed, to provide essentially the same sheet 12 forward movement along a sheet path. Baffles 14 partially define an exemplary paper path in FIG. 1. The direction of the sheet path is shown by arrow 50 in FIG. 2.

With continued reference to FIG. 1, a skew drive assembly is provided to allow the drive rollers 15A and 15B to rotate at different speeds when sheet de-skewing is desired. The desired amount of de-skew is provided in the example of FIG. 1 by slightly varying the angular speed of the nip 17B relative to the nip 17A for a predetermined period of time. The skew drive assembly includes motor M2 which is fastened to the shaft 92B by a connector 88, and moves laterally with the shaft. When the de-skew motor M2 is actuated by the controller 100, the motor M2 rotates its screw shaft 87. The screw shaft 87 engages with its screw threads the mating threads of a female nut 86, with includes an anti-rotation arm 86A. The shaft 89 is rotatably connected to the nut 86, such that rotation of the screw shaft 87 by the motor M2 moves the shaft 89 (and thus hollow shaft 83) axially towards or away from the motor M2, depending on the direction of rotation of its screw shaft 87. A relatively small such axial or lateral movement of the shaft 83 moves its two attached gears 82 and 84 laterally relative to the opposing shaft 92B on which the drive rollers 15A and 15B are mounted. The straight gear 82 can move laterally relative to its mating straight gear without causing any relative rotation. However, in contrast, the translation of the mating helical gear connection between the gears 84 and 85 causes a rotational shift of the nip 17B relative to the nip 17A. That differential shift in rotational positions is in proportion to, and corresponds to, the amount of rotation of the screw shaft 87 by the deskew motor M2. This provides the desired sheet deskew. Reversal of the deskew motor M2 when a sheet is not in the nips 17A and 17B can then re-center the deskew system for the next sheet.

The registration system 10 also includes a lateral offset drive assembly 76. The lateral offset drive assembly 76 includes a motor M3 that drives a rack and gear drive 90. The rack and gear drive includes shafts 92A and 92B. These shafts 92A and 92B form a "U" shape or "trombone-slide" shape. Rotation of the motor M3 moves the rack and gear drive from side-to-side. The amount of lateral shifting is controlled by the controller 100, which controls the amount of rotation of motor M3. As shafts 92A and 92B move laterally, the drive rollers 15A and 15B and idler rollers 16A and 16B also mover laterally. Since the upper and lower shafts 92A and 92B are parallel and are fastened together into a single slide unit, the drive rollers 15A and 15B will move laterally by the same amount as the idlers 16A and 16B, to maintain, but laterally move, the two nips 17A and 17B.

The registration system 10 is particularly useful in duplex printing machines operable to print images on both sides of a sheet. An exemplary duplex printing machine 101 is shown schematically in FIG. 4, and operation of the registration system in such a duplex printing machine is described below.

Figure 4:
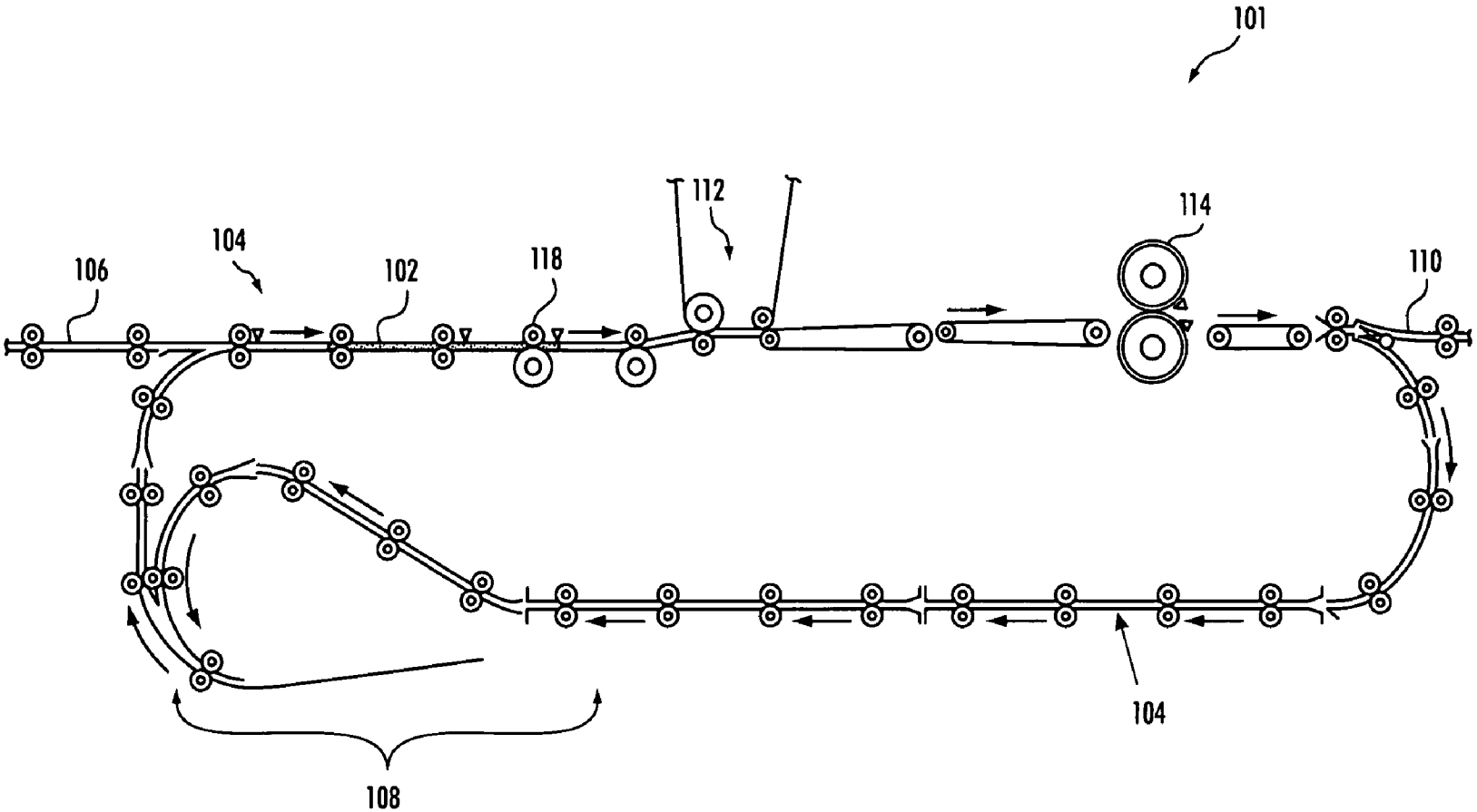
FIG. 4 shows a schematic side view of an exemplary printing machine and sheet transport system that may incorporate the registration and measurement system of FIG. 1.

With reference to FIG. 4, the printing machine 101 includes a sheet feeder 106 operable to deliver each sheet from a stack into a transfer path 104. The sheet 102 first enters the transfer path with a leading edge of the sheet and a trailing edge following behind. After entering the transfer path 104 the sheet 102 then encounters the sheet registration system 118 to undergo a first registration process. In one embodiment, the registration system 118 comprises the registration and measurement system described above with respect to FIGS. 1 and 2.

With respect to FIGS. 1 and 2, shortly after a sheet 12 enters nips 17A and 17B, the sheet passes under optical sensors 120A and 120B. The optical sensors detect the presence of the sheet when the leading edge of the sheet passes under the sensor. Thus, if the sheet is skewed, one optical sensor will detect the presence of the sheet before the other optical sensor. For example, sensor 120A may detect the presence of the sheet before sensor 120B if the sheet is skewed. When the sheet enters the nips 17A and 17B, the idler rollers 16A and 16B rotate upon the surface of the sheet at substantially the same velocity as the sheet. Thus, the rotary encoders 110A and 110B on the idler rollers 16A and 16B provide an estimate of the velocity of the sheet. The rotary encoders 110A and 110B send an output signal to the controller 110 representative of the velocity of the sheets. The controller 110 monitors the rotary encoders to receive the signal representative of velocity, then the controller 110 multiplies the velocity of the sheet by the difference between the time the leading edge of the sheet passed under the first optical sensor and the time the leading edge passed under the second optical sensor. This calculation provides the distance between the leading edge at the first sensor and the leading edge at the second sensor in the paper path direction 50. This distance along with the known distance between the two optical sensors 120A and 120B allows the controller 100 to calculate the skew angle of the leading edge of the sheet.

The controller 100 not only calculates the skew angle, but is also operable to calculate the length of the sheet from the leading edge to the trailing edge. In particular, the optical sensors 120A and 120B detect the presence of the leading edge of the sheet. Then, after the sheet passes through the nips 17A and 17B, the optical sensors 120A and 120B detect the absence of the sheet. This provides the controller with a time for the sheet to pass under the optical sensors 120A and 120B.

The velocity of the sheet during this time is estimated to be the velocity of the idler rollers 16A and 16B, as measured by the rotary encoders 110A and 110B. By multiplying the time the sheet is under each optical scanner by the velocity of the sheet during this time, the controller arrives at two separate measurements for the length of the sheet from the leading edge to the trailing edge. If the two distances measured from the leading edge to the trailing edge of the sheet are equal, the controller notes that the sheet is substantially rectangular. However, if the two distances measured across the sheet are not equal during this first registration process, the controller notes the distance differential for use during a second registration process for duplex imaging.

In addition to determining whether the sheet is substantially rectangular, the controller is also operable to determine whether the two distances measured from leading edge to trailing edge of the sheet are expected distances. For example, if the expected paper size is standard letter, the distance across the sheet should be 8.5 inches. While the sheet skew, if any, may slightly add to this distance, the controller may revise the expected distance measurement based on the skew angle. Thus, if the measured distance across the sheet from leading edge to trailing edge is larger or smaller than expected, the controller notes this distance to adjust the print area for duplex printing purposes, as explained in further detail below.

If any skew, lateral offset, or process errors are determined during the registration process, the registration system may be used to correct the skew, lateral offset and/or process errors. To this end, the registration system may comprise at least one drive nip having a skew drive assembly and a lateral offset drive assembly, similar to that shown in FIG. 1. For example, in one embodiment, the registration system includes a first set of nip drives with associated optical sensors to measure skew and sheet length; the registration system further includes a second set of nip drives with an associated skew drive assembly, such as that shown in FIG. 1, to correct for the measured skew once the sheet has passed through the first set of nip drives.

With reference again to FIG. 4, after passing through the registration system 118, the sheet 102 is then passed to the imager 112 operable to place an image on the first side of the sheet. As will be recognized by those of skill in the art, the sheet may also be subjected to a fuser 114, depending upon the type of printing machine. Next, the sheet is routed along a duplex path 104 back toward the registration system, rather than being sent to a paper output 110. The duplex path 104 includes an inverter 108. The inverter 108 flips the sheet such that the leading edge of the sheet becomes the trailing edge of the sheet during the second pass through the registration system. After inversion, the sheet is returned to the transfer path 104 for re-registered of the sheet for the second imaging process.

Figure 5:
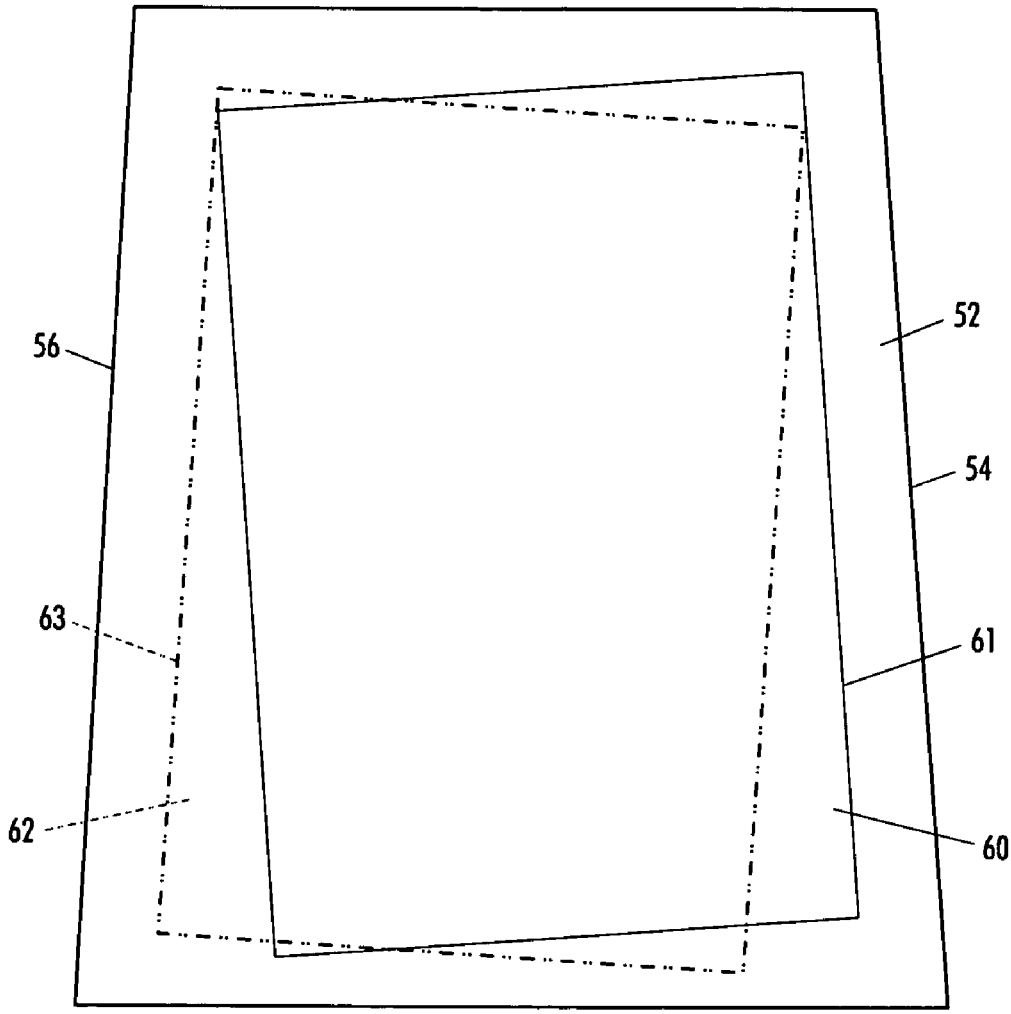
FIG. 5 shows a schematic view of a duplex sheet having an image area on a first side that is misaligned with an image area on the reverse side.

During the second registration process, skew may actually be introduced to the leading edge of the sheet if the controller determined that the sheet was non-rectangular when the length of the sheet was measured during the first registration process. For example, assume the controller calculates no skew in the leading edge of the sheet during the first registration process, but does determine that the sheet is non-rectangular. In particular, the controller calculates that the leading edge and trailing edge are 2° away from parallel. The printing machine then proceeds with printing an image in a first image area that has a border parallel to the leading edge of the paper. After creation of the first image, the sheet is returned to the registration system for duplex imaging. This time, the sheet flipped and the formerly leading edge during the first imaging process is now the trailing edge. The registration system receives the leading edge of the sheet, and the optical scanners determine that the leading edge is correctly positioned perpendicular to the desired paper path. However, because the controller determined during the first registration process that the leading edge and trailing edge are 2° removed from parallel, the registration system actually introduces 2° of skew to the leading edge of the sheet. This action aligns the second image area directly over the first image area, with one border parallel to one edge of the sheet. Following the second imaging process, the first image area and second image area are arranged directly on top of each other and are both aligned with the same edge of the paper. Thus, the situation described above with reference to FIG. 5 is avoided, where a first image area is aligned with one edge and a second image area is aligned with an opposite edge during the duplex printing process. Instead, the above-describe procedure would result in the dotted line of FIG. 5, which represents the second image area, being placed directly over the solid line of FIG. 5, which represents the first image area.

In addition to the above-described example where the controller aligns the first image area and second image area with one of the sheet edges, the controller may also be programmed to perform a centering operation where the first image area and second image area are directly on top of each other, but not directly aligned with either edge. For example, in the case of a 2° angle between the leading edge and the trailing edge, the image areas may be aligned with their borders at a 1° angle from each edge. In this embodiment, the optical sensors and rotary encoders are associated with a first set of drive nips upstream from a second set of drive nips operable to correct for skew and lateral offset. By separating the optical sensors and rotary encoders from the skew and lateral offset drives in this manner, the controller has sufficient time to make measurements at the first set of drive nips and perform a skew and lateral offset correction at the second set of drive nips.

Figure 3A:
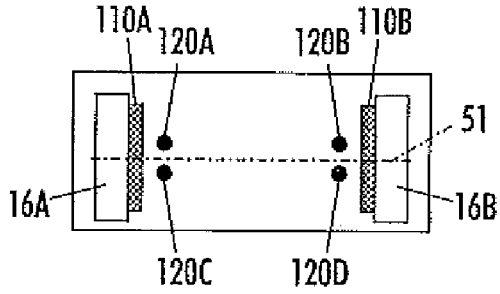
FIGS. 3A-3G show cross-sectional view of alternative embodiments of the registration and measurement system of FIG. 2.

Numerous other alternative embodiments for the sheet registration and measurement system are possible. For example, FIGS. 3A-3H show cross-sectional views of alternative embodiments of the registration system of FIG. 1 through line FIG. 2-FIG. 2 shown in FIG. 1. In FIG. 3A, four optical sensors 120A-120D are provided in proximity of the two rotary encoders 110A, 110B. By using four optical sensors, a more accurate measurement of the velocity of a sheet as it travels through the nips 17A and 17B is obtained. In particular, the four optical sensors of FIG. 3A allow the controller to take a velocity measurement for the sheet when it is controlled exclusively by nips 17A and 17B. Specifically, after a sheet enters the nips 17A and 17W the forward optical sensors 120A and 120B detect the presence of the leading edge of the sheet. The velocity of the sheet is measured by rotary encoders 110A and 110B. After the trailing edge of the sheet passes the rear optical sensors 120C and 120D, the controller calculates the amount of time between the detection of the sheet by the forward sensors and the passing of the sheet from the rear sensors. This time is multiplied by the velocity of the sheet during this time, as taken by the rotary encoder, resulting in a first distance measurement. This first distance measurement is then added to the distance between the set of forward optical sensors 120A and 120B and the set of rear optical sensors 120C and 120D to arrive at a measurement from the leading edge to the trailing edge of the sheet.

Figure 3B:
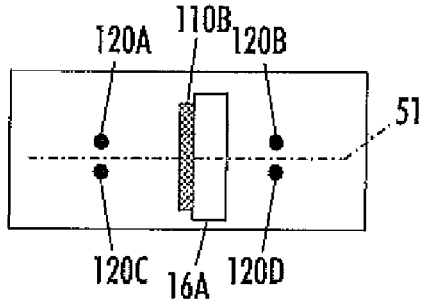
Figure 3C:
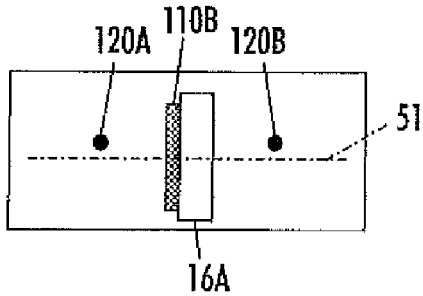
Figure 3D:
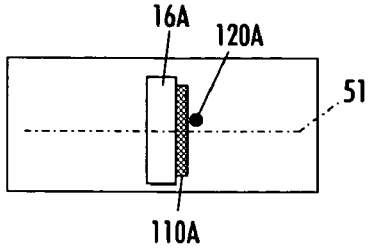
Figure 3E:
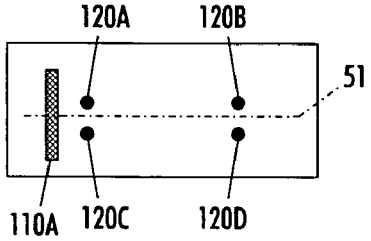
Figure 3F:
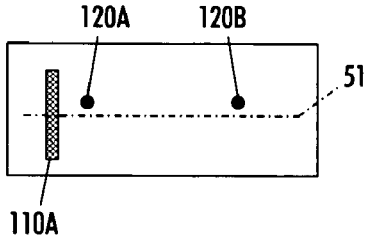
Figure 3G:
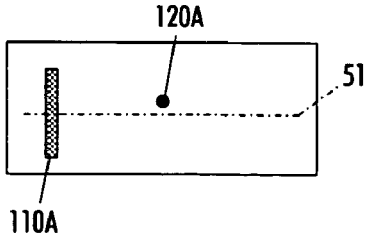

FIG. 3B shows an arrangement similar to FIG. 3A, but only a single idler 110B is used in association with a single nip drive to transfer the sheet along the desired path. Similarly, FIG. 3C shows an arrangement similar to FIG. 3B, but only two optical sensors 120A, 120B are used in the embodiment of FIG. 3C to monitor the presence of a sheet. FIG. 3D shows an arrangement similar to FIG. 3C, but only a single optical sensor is used to monitor the presence of a sheet. FIGS. 3E-3H show alternate embodiments with four, two and one optical sensor. In each of the embodiments of FIGS. 3E-3H, the rotary encoder 110A is attached to a shaft 51 that turns with the idlers (not shown in FIGS. 3E-3F). Of course numerous other alternative embodiments for the sheet registration and measurement system are possible. For example, the sheet measurement system may be provided in a printing machine separate from a registration system capable of correcting for skew, lateral offset, or process errors. Accordingly, the sheet measurement system may be provided at any location in the sheet path of the printing machine. In addition, a rotary encoder could be attached to the drive rollers rather than the idler rollers. In another embodiment, the rotary encoder is attached to a motor shaft that powers a drive train operable to turn the drive rollers. In such embodiment, the controller is used to determine the angular velocity of the drive rollers based upon a predefined relationship between the motor shaft and the drive train.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A sheet measurement system operable to receive a sheet, the sheet measurement system comprising:

a) at least one nip parameter sensor operable to provide a nip parameter signal;

b) at least one sheet sensor operable to detect the sheet, the at least one sensor operable to provide a sheet detection signal;

c) an imager configured to place images on the sheet; and d) a processor operably connected to the at least one nip parameter sensor and the at least one sheet sensor, the processor operable to determine a distance based upon the nip parameter signal and the sheet detection signal, the processor further operable to determine a first skew or first offset to be introduced to the sheet before a first image is printed in a first image area on a first side of the sheet and a second skew or second offset to be introduced to the second side of the sheet before a second image is printed in a second image area on a reverse side of the sheet such that the second image area on the reverse side of the sheet will be directly aligned on the sheet with the first image area, wherein the determined first skew or first offset and second skew or second offset are based at least in part on the distance determined by the processor.

2. The sheet measurement system of claim 1 wherein the sheet measurement system comprises part of a sheet registration system.

3. The sheet measurement system of claim 1 further comprising at least one roller pair including a drive roller and an idler roller, wherein the nip parameter sensor is operably connected to the at least one roller pair.

4. The sheet measurement system of claim 3 wherein the nip parameter signal indicates the rotational speed of the idler roller.

5. The sheet measurement system of claim 3 further comprising a rotatable shaft operably connected to roller pair, and wherein the nip parameter signal indicates the rotational speed of the shaft.

6. The sheet measurement system of claim 3 wherein the nip parameter signal indicates a distance of travel of the idler roller relative to the sheet.

7. The sheet measurement system of claim 3 wherein the at least one nip parameter sensor comprises a rotary encoder attached to the idler roller, the rotary encoder operable to provide the nip parameter signal.

8. The sheet measurement system of claim 1 wherein the at least one sheet sensor comprises an optical sensor.

9. The sheet measurement system of claim 3 wherein the at least one roller pair comprises an inboard roller pair and an outboard roller pair.

10. The sheet measurement system of claim 9 wherein the at least one nip parameter sensor comprises an inboard sensor and an outboard sensor.

11. The sheet measurement system of claim 10 wherein the first skew or first offset introduced to the first side of the sheet and the second skew or second offset introduced to the second side of the sheet results in the first image area and the second image area being relatively centered between a first edge and a second edge of the sheet.

12. The sheet measurement system of claim 10 wherein the distance calculated based on the nip parameter signal and the sheet detection signal includes an inboard distance of the sheet and outboard distance of the sheet.

13. The sheet measurement system of claim 12 wherein the direct alignment of the first image area and the second image area on the sheet is such that the first image area is substantially symmetric to the second image area with respect to an edge of the sheet.

14. A printing machine operable to print an image on a first side and a reverse side of a sheet, wherein the sheet includes a first edge and a second edge, the printing machine comprising:

a) at least one nip assembly including a drive roller and an idler roller, the nip assembly operable to receive the sheet between the drive roller and the idler roller, and the nip assembly operable to provide a nip parameter signal;

b) at least one sensor operable to detect the sheet received between the drive roller and the idler roller, the at least one sensor operable to provide a sheet detection signal;

c) a processor operable to determine a distance between the first edge of the sheet and the second edge of the sheet based upon the nip parameter signal and the sheet detection signal, and wherein the processor is further operable to determine a first image area for the first side of the sheet and a second image area for the reverse side of the sheet, the first image area being substantially symmetric to the second image area with respect to the first edge of the sheet; and d) an imager operable to create a first image within the first image area on the first side of the sheet and a second image within the second image area on the reverse side of the sheet, wherein the processor is configured to determine a first skew or first offset to be introduced to the sheet before the first image is printed on the first side of the sheet and a second skew or second offset to be introduced to the sheet before the second image is printed on the reverse side of the sheet such that the first image area and the second image area are directly aligned and relatively centered between a first edge and a second edge of the sheet.

15. The printing machine of claim 14 wherein the at least one nip assembly comprises a portion of a registration assembly, the printing machine further comprising an inverter operable to invert the first side and the reverse side of the sheet, and a duplex path conveyor operable to return the inverted sheet to the registration assembly.

16. The printing machine of claim 14 wherein the first image area includes a first boundary that is not substantially parallel to the first edge of the sheet.

17. The printing machine of claim 16 wherein the first image area is substantially equally spaced between the first edge and the second edge of the sheet.

18. The printing machine of claim 14 further comprising a rotary encoder operably connected to the idler roller, wherein the rotary encoder is operable to provide the nip parameter signal.

19. A method of registering a sheet in a printing machine, the sheet including a first side and a reverse side, the printing machine comprising at least one nip assembly having at least one roller, the method comprising:

a) receiving the sheet in the nip assembly;

b) detecting the sheet and monitoring rotation of the at least one roller;

c) determining a length of the sheet based on the detection of the sheet and the monitored rotation of the at least one roller;

d) introducing a skew to the first side of the sheet and producing a first image in a first image area on the first side of the sheet after the skew is introduced to the first side of the sheet; and e) introducing the skew to the reverse side of the sheet before a second image is produced in a second image area on the reverse side of the sheet, wherein the skew introduced to the first side and the second side of the sheet results in the first image area and the second image area being directly aligned on the sheet and relatively centered between a first edge and a second edge of the sheet.

20. The method of claim 19 wherein the detection of the sheet includes determining an amount of time the sheet passes a sensor, and wherein the monitoring of the rotation of the at least one roller includes determining a surface velocity for the at least one roller during the time the sheet passes the sensor, and wherein the determining of the length of the sheet includes multiplying the time the sheet passes the sensor by the surface velocity of the at least one roller.

21. The method of claim 19 wherein the direct alignment of the first image area and the second image area results in the first image area being substantially symmetric to the second image area with respect to an edge of the sheet.

22. The method of claim 19 further comprising inverting the sheet after producing the first image, and further comprising producing the second image on the second side of the sheet in the second image area after the offset is introduced to the sheet.

* * * * *